United States Patent [19]

Yaeger

[11] Patent Number: 4,940,475

[45] Date of Patent: Jul. 10, 1990

[54] VARIABLE CAPACITY EVAPORATIVE HUMIDIFIER

[76] Inventor: Ronald J. Yaeger, 5006 Mill Creek, Dallas, Tex. 75244

[21] Appl. No.: 412,950

[22] Filed: Sep. 26, 1989

[51] Int. Cl.[5] ..... B01F 3/04

[52] U.S. Cl. ..... 55/224; 55/226; 55/233; 55/257.2; 55/440; 261/23.1; 261/96; 261/57

[58] Field of Search ..... 55/224, 226, 233, 257.2, 55/257.3, 440; 261/23.1, 96, 63, 54, 57

[56] References Cited

U.S. PATENT DOCUMENTS

| | | | |
|---|---|---|---|
| 2,906,512 | 9/1959 | Meek | 261/96 |
| 3,267,648 | 8/1966 | Allcorn, Jr. | 261/23.1 |
| 3,334,471 | 8/1967 | Herron | 261/63 |
| 3,596,439 | 8/1971 | Moragne | 261/96 |
| 3,856,487 | 12/1974 | Perez | 55/226 |
| 4,093,433 | 6/1978 | Smith | 261/23.1 |
| 4,175,933 | 11/1979 | James | 55/233 |
| 4,308,222 | 12/1981 | Goettel et al. | 55/257.2 |
| 4,494,596 | 1/1985 | Bradshaw | 55/226 |
| 4,543,108 | 9/1985 | Wurz | 55/440 |

FOREIGN PATENT DOCUMENTS

| | | | |
|---|---|---|---|
| 2073604 | 10/1981 | United Kingdom | 261/23.1 |

*Primary Examiner*—Tim Miles

*Attorney, Agent, or Firm*—Glaser, Griggs & Schwartz

[57] ABSTRACT

A variable capacity evaporative humidifier includes a housing, evaporative media disposed within the housing, and variable bypass apparatus for diverting a portion of the flow of air through the housing away from the evaporative media, such that the rate of moisture added to the flow of air through the housing is variable by selecting the relative proportions of air flowing through the evaporative media and the bypass passageway. Deflector panels disposed downstream of the evaporative media and damper blades disposed within the bypass apparatus intermix the bypass airstream with the humidifier airstream, thereby avoiding stratification.

5 Claims, 3 Drawing Sheets

VARIABLE CAPACITY EVAPORATIVE HUMIDIFIER

FIELD OF THE INVENTION

This invention is directed to air humidification apparatus, and more particularly to an evaporative humidifier having a variable capacity.

BACKGROUND OF THE INVENTION

Evaporative humidifiers typically include an airflow plenum housing, a water reservoir, a blower for producing a positive pressure flow of air through the plenum housing, and an evaporative core coupled to the reservoir for imparting moisture to air flowing through the housing. The evaporative core is maintained in a moist state by means of a water supply system which circulates water from the reservoir to evaporative media within the core, with water trickling through the core for evaporation into the air flowing through the evaporative media. The evaporation rate, and therefore the humidification performance of the apparatus, is directly related to the rate of air flow through the evaporative core.

Bypass dampers have been successfully used in the past for capacity control of evaporative humidifiers. A limitation on the operation of conventional variable capacity humidifiers, however, has been that the flow exiting the humidifier station is stratified. That is, the portion of the airstream output from the evaporative core is cooler and more humid than the bypass portion of the airstream flowing through the bypass damper, which may be at ambient temperature and humidity, or preheated to an elevated temperature and reduced humidity level for control purposes.

Another limitation of conventional humidifiers relates to reliability and maintenance requirements. Conventional multistage humidifiers include evaporative media having a thickness of approximately six inches. It is not uncommon for conventional evaporative media core structures to catastrophically fail by twisting, bowing or collapsing.

Accordingly, there presently exists a need for a variable capacity evaporative humidifier which avoids the problem of stratification inherent in the operation of a conventional bypass damper configuration. In addition, an evaporative humidifier configured to reduce the media failure problems experienced in the past is needed.

SUMMARY OF THE INVENTION

An improved evaporative humidifier having variable capacity includes integral bypass dampers which control the relative proportions of air flowing through a bank of evaporative cores and bypass passageways located between the cores. Stratification is avoided by moisture eliminator walls which are positioned downstream of the evaporative cores and which are angled to direct air exiting from the evaporative cores to intermix with air exiting from the bypass passageways. Media failure in the improved evaporative humidifier is prevented by providing large monolithic blocks of media that are approximately twenty-four inches deep in the direction of air flow. plastic coated wire mesh walls on both inlet and outlet faces of the evaporative cores in combination with the relatively deep blocks of media provide sufficient strength to avoid twisting, bowing and structural collapse.

BRIEF DESCRIPTION OF THE DRAWINGS

A more complete understanding of the invention and its advantages will be derived from the Detailed Description of the Preferred Embodiment when read with reference to the accompanying drawings, in which.

DETAILED DESCRIPTION OF THE PREFERRED EMBODIMENT

Figure 1:
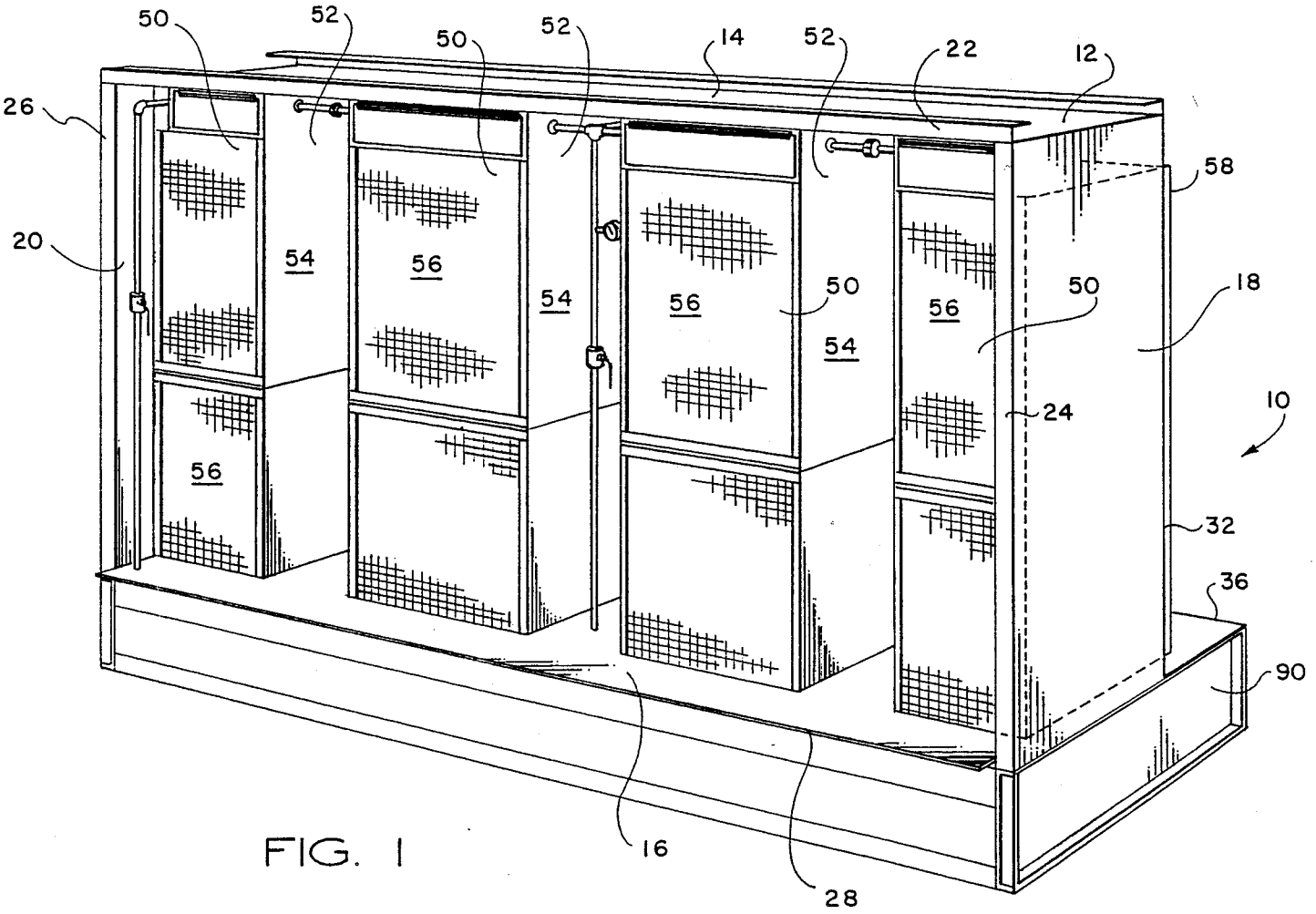
FIG. 1 is a perspective view of an evaporative humidifier constructed in accordance with the invention.

Referring initially to FIGS. 1, 2, 3 and 4, where like numerals designate like and corresponding elements, humidifier 10 includes a housing 12 defined by a top housing wall 14, a bottom housing wall 16 and two housing sidewalls 18 and 20. A housing inlet is formed by front lateral edge 22 of top housing wall 14, front lateral edges 24 and 26 of housing sidewalls 18 and 20, respectively, and front lateral edge 28 of bottom housing wall 16. A housing outlet is formed on the end of housing 10 opposite the housing inlet by rear lateral edge 30 of top housing wall 14, rear lateral edges 32 and 34 of housing sidewalls 18 and 20, respectively, and rear lateral edge 36 of bottom housing wall 16.

A plurality of evaporative cores 50 are mounted adjacent one another transversely within housing 12. Each core 50 includes side core walls 52 which are laterally spaced apart to define bypass gaps 54 between cores 50. Cores 50 also include front core walls 56 facing the housing inlet and back core walls 58 facing outwardly from the housing outlet. The front and back core walls 56 and 58, respectively, are permeable to allow the flow of air through cores 50. Preferably, front and back core walls are formed of PVC plastic coated wire mesh to add strength to cores 50. Approximately twenty-four inches of evaporative media 60 (FIG. 4) are retained by front and back core walls 56 and 58, respectively.

The humidification capacity of humidifier 10 is rendered variable by a bypass damper having a pair of opposed blades 70 mounted for pivoting movements in each of the bypass gaps 54. Blades 70 are movable about central parallel vertical axes 72 between closed and open positions. Blades 70 substantially block bypass gaps 54 to the flow of air therethrough in the closed position and substantially open bypass gaps 54 to the flow of the air therethrough in the open position. A control system (not shown) includes a power actuator coupled to the blades 70 for positioning the blades in the closed and open positions and at positions intermediate the closed and open positions in a stepless, continuously variable fashion.

Figure 2:
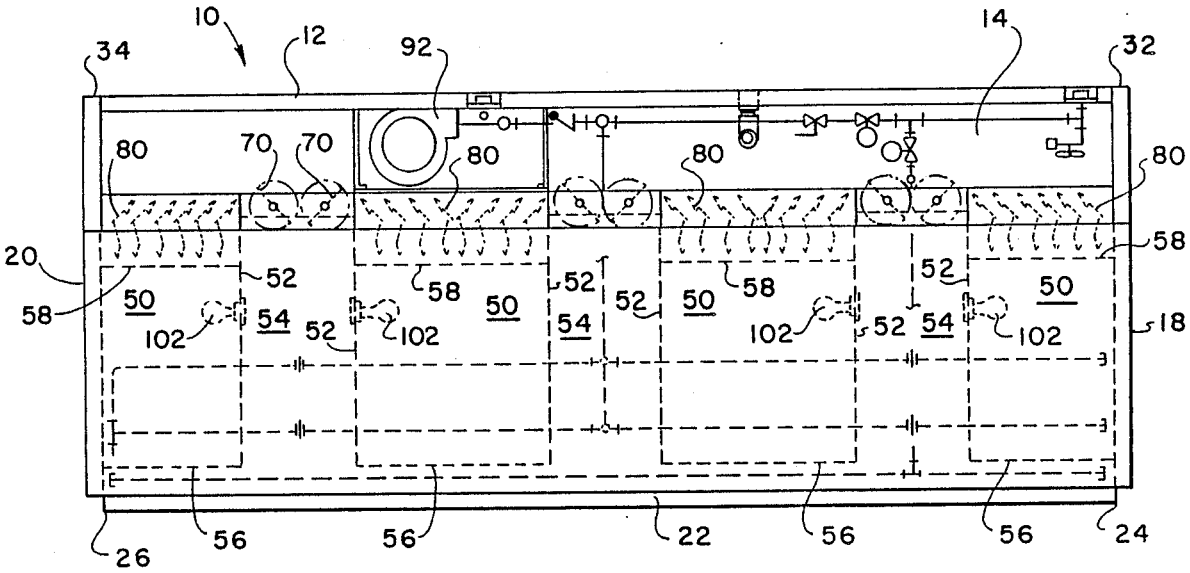
FIG. 2 is a schematic overhead view of the humidifier in FIG. 1.
Figure 3:
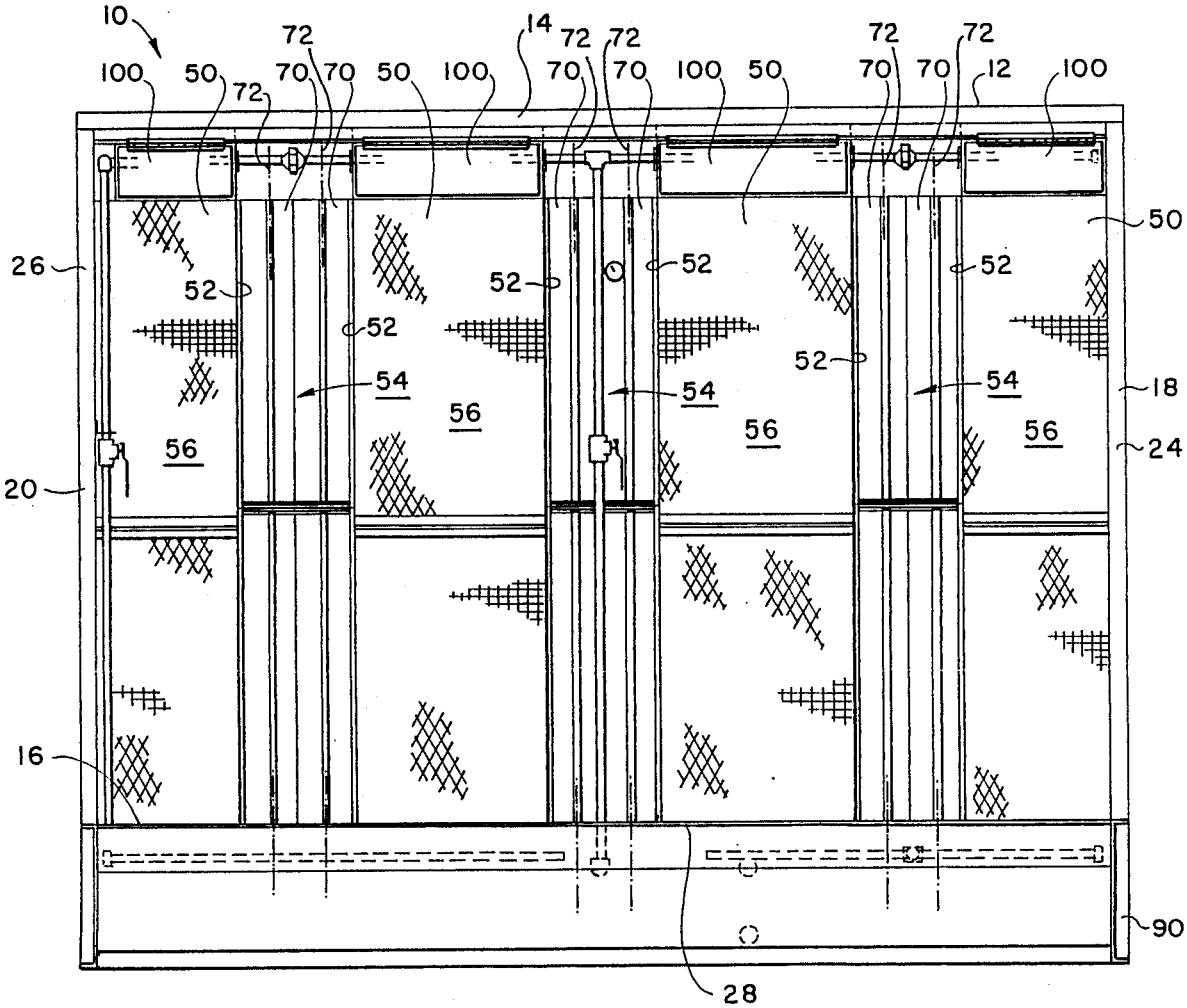
FIG. 3 is a front elevation view of the humidifier of FIG. 1.
Figure 4:
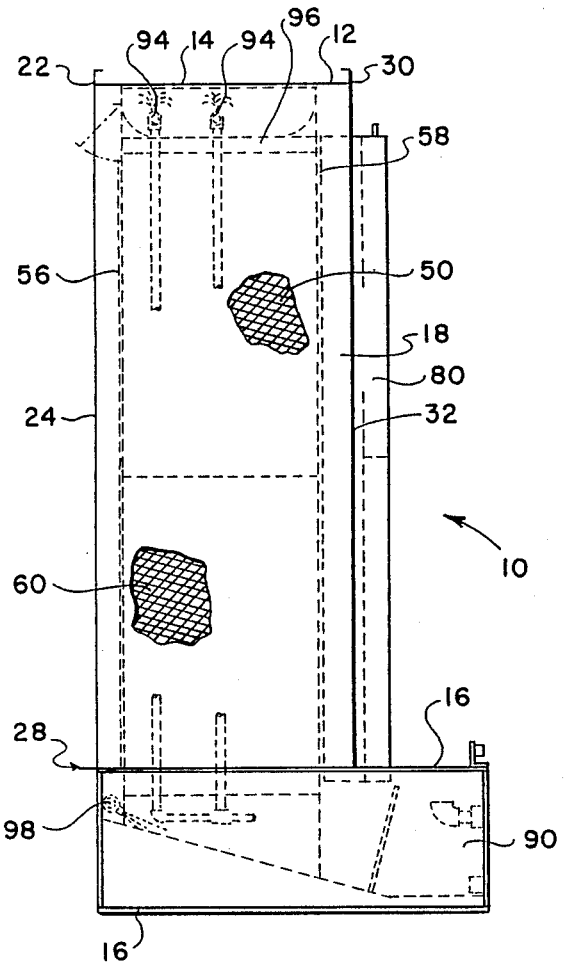
FIG. 4 is a partially broken away side view of the humidifier of FIG. 1.

A plurality of moisture eliminator walls 80 extend vertically between the top housing wall 12 and the bottom housing wall 16. Moisture eliminator walls 80 are laterally spaced and are located immediately downstream of core back walls 58, as best shown in FIGS. 2 and 4. As shown in FIG. 2, each of the moisture eliminator walls 80 is angled in the direction of the bypass gap 54 in closest lateral proximity to the moisture eliminator wall 80. The preferred moisture eliminator blades are spaced approximately 1.2 inches apart and are formed of polypropylene.

A water supply system for the apparatus includes a tank 90 located below bottom housing walls 16. A pump 92 (FIG. 2) and spray headers 94 (FIG. 5) are provided to supply water to a distribution pad 96. Distribution pad 96 evenly distributes water across the top portion of evaporative media 60 to achieve uniform wetting of the evaporative media. A flooding header 98 is provided to accommodate tank filling and flushing. Preferably, capability for either recirculating or non-recirculating operation and automatic tank draining are provided. Hinged viewport doors 100 (FIG. 3) are provided to permit inspection of the spray chambers. Light fixtures 102 (FIG. 2) are provided to permit inspection of the evaporative cores.

Figure 5:
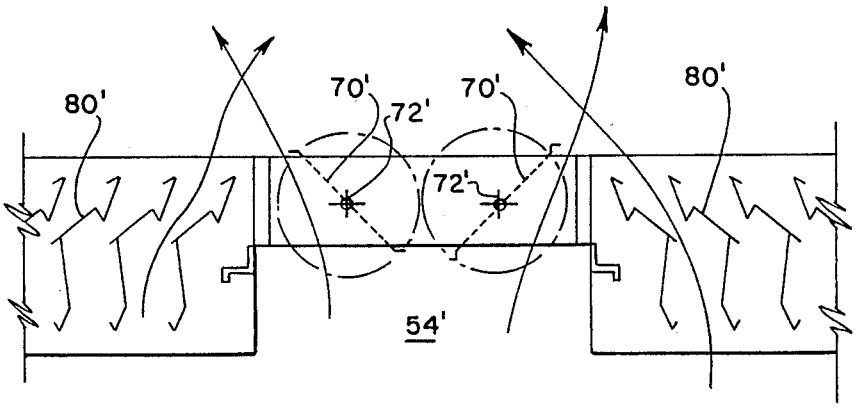
FIG. 5 is a schematic partial overhead view illustrating the moisture eliminator walls and bypass damper of the invention; and, FIG. 6 is a schematic partial view illustrating an alternate embodiment of the bypass damper of the invention.

Referring now to FIG. 5, a pair of opposed bypass damper blades 70' are shown partially rotated about axes 72' and positioned intermediate the closed and open positions. It will be appreciated that blades 70' substantially span bypass gap 54' when in the closed position and in the open position are aligned with the flow of air through bypass gap 54 to offer minimum flow resistance. The moisture eliminator walls 80', as shown, have articulated wall panel sections which are folded transversely with respect to each other. In the preferred embodiment, the moisture eliminator walls 80' are angled in the direction of the bypass gap 54', which is in closest lateral proximity to the moisture eliminator walls 80', as shown in FIG. 5.

Thus it can be seen that the flow of air through the evaporative cores and bypass passageways will undergo turbulent intermixing immediately downstream of humidifier 10 as shown by the crossing arrows in FIG. 5. The two airstreams, which differ both in temperature and relative humidity, are therefore directed at one another for improved mixing action.

Figure 6:
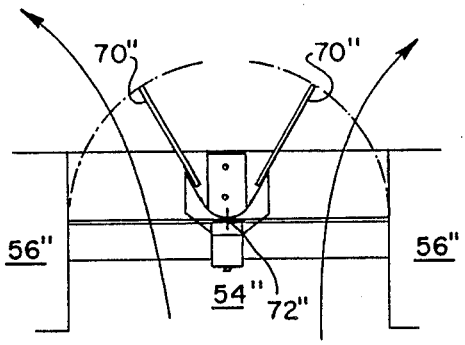

Referring now to FIG. 6, an alternate embodiment of the invention includes a butterfly-type bypass damper wherein blades 70'' are mounted for movements about a lateral parallel vertical axis 72'' between closed and open positions. Axis 70'' is centrally located in bypass gap 54'', such that when open, blades 70'' direct air into the areas downstream of the adjacent evaporative cores 56''.

In operation, evaporative humidifier 10 achieves high humidification efficiency by providing stepless, variable capacity control through integral bypass dampers and relatively deep evaporative media 60. Moisture eliminator walls 80 control liquid water flow into the airstream passing through the apparatus. The preferred humidifier is highly reliable and is capable of being on-line 100% of the time with planned maintenance. The large, monolithic blocks of media, preferably twenty-four inches deep in the direction of airflow, and PVC coated wire retainers on both faces enable sufficient core strength to avoid structural collapse. Preferably, a weekly automatic drain, flush and drying of the system is scheduled to reduce the time expended by maintenance personnel associated with the apparatus and to reduce the possibility of biological fouling by regular complete drying of the media.

Maximum possible saturation efficiency with a wide range of control is provided so that the improved humidifier will satisfy all present and future system conditions without modification. Stratification is avoided by the use of opposed bypass damper blades 70 and angled moisture eliminator walls 80, which cause the two airstreams flowing through the bypass gaps 54 and evaporative cores 50 to intermix. An added benefit of the relatively thick media and angled moisture eliminator walls is a somewhat increased air resistance through the evaporator cores and moisture eliminator walls, which prevents an uneven flow distribution across housing 12 where a higher velocity region is located in the center of the housing.

A reduced operating expense for the evaporative humidifier results from avoidance of media replacement. This feature is obtained by incorporating the plastic coated wire mesh core walls 56 and 58, by thoroughly wetting the media during operation, and by periodically drying the media completely. In addition, when the humidifier is not in operation, the bypass damper blades 70 can be fully opened, thereby lowering the system's air resistance and power requirements of the supply fan.

While preferred embodiments of the present invention have been described in detail herein and illustrated in the accompanying drawings, it will be evident that various further modifications are possible without departing from the scope of the invention.

What is claimed is:

1. A humidifier for adding moisture to a flow of air comprising, in combination:

a housing having inlet, an outlet and a flow passage between said inlet and outlet;

a plurality of evaporative cores mounted adjacent one another within said housing passage, said evaporative cores including core sidewalls defining bypass gaps between said cores;

a pair of bypass damper blades mounted for pivoting movement in each of said bypass gaps between closed and open positions, said bypass damper blades substantially blocking said bypass gaps to the flow of air therethrough in said closed positions and substantially opening said bypass gaps to the flow of air therethrough in said open positions, and said bypass damper blades being selectively positionable at said closed and open positions and at positions intermediate said closed and open positions; and, a plurality of moisture eliminator walls disposed within said housing, each moisture eliminator wall being angled in the direction of the bypass gap in closest lateral proximity thereto, whereby the flow of air exiting from each evaporative core is intermixed with the flow of air exiting from said bypass gap.

2. A humidifier for adding moisture to a flow of air through the humidifier comprising, in combination:

a housing defined by a top housing wall, a bottom housing wall and two side housing walls, with lateral edges on opposite sides of said top, bottom and side housing walls forming a housing inlet on one end of said housing and a housing outlet on an opposite end of said housing;

a plurality of evaporative cores mounted adjacent one another transversely within said housing, said evaporative cores including core sidewalls vertically and laterally spaced apart to define bypass gaps between said cores, front core walls, and back core walls;

a plurality of moisture eliminator walls disposed between said top and bottom housing walls and being spaced laterally immediately downstream of said core back walls, with each said moisture eliminator wall being angled in the direction of the bypass gap in closest lateral proximity thereto, such that the flow of air exiting from each said evaporative core is intermixed with the flow of air exiting from said bypass gap; and, a bypass damper having two opposed blades mounted for pivoting movement in each of said bypass gaps between closed and open positions, said bypass dampers substantially blocking said bypass gaps to the flow of air therethrough in said closed positions and substantially opening said bypass gaps to the flow of air therethrough in said open positions, and said bypass dampers being selectively positionable at said closed and open positions and at positions intermediate said closed and open positions, such that as said damper is opened, said two blades are angled in the direction of said evaporative core in closest lateral proximity thereto and the flow of air exiting from said bypass gap is intermixed with the flow of air exiting from said dampers.

3. A humidifier for adding moisture to a flow of air through the humidifier comprising, in combination:

a housing defined by a top housing wall, a bottom housing wall and two side housing walls, with lateral edges on opposite sides of said top, bottom and side housing walls forming a housing inlet on one end of said housing and a housing outlet on an opposite end of said housing;

a plurality of evaporative cores mounted adjacent one another transversely within said housing, said evaporative cores including vertical sidewalls laterally spaced apart to define bypass gaps between said cores, front core walls and back core walls;

said front and back core walls being formed of permeable plastic coated wire mesh to allow the flow of air therethrough, with said cores including evaporative media within said core walls for adding moisture to the air flowing through said cores;

a plurality of moisture eliminator walls extending vertically between said top and bottom housing walls and being spaced laterally immediately downstream of said core back walls, with each said moisture eliminator wall being angled in the direction of the bypass gap in closest lateral proximity thereto, such that the flow of air exiting from each said evaporative core is intermixed with the flow of air exiting from said bypass gap; and, a bypass damper having two opposed blades mounted for pivoting movement in each of said bypass gaps between closed and open positions, said bypass dampers substantially blocking said bypass gaps to restrict the flow of air therethrough in said closed positions and substantially opening said bypass gaps to admit the flow of air therethrough in said open positions, and said bypass dampers being selectively positionable at said closed and open positions, wherein as said damper is opened, said two blades are angled in the direction of said evaporative core in closest lateral proximity thereto and the flow of air exiting from said bypass gap is intermixed with the flow of air exiting from said dampers.

4. A humidifier for adding moisture to a flow of air through the humidifier comprising, in combination:

a housing defined by a top housing wall, a bottom housing wall and two side housing walls, with lateral edges on opposite sides of said top, bottom and side housing walls forming a housing inlet on one end of said housing and a housing outlet on an opposite end of said housing;

a plurality of evaporative cores mounted adjacent one another transversely within said housing, said evaporative cores including vertical sidewalls laterally spaced apart to define bypass gaps between said cores, front core walls and back core walls;

a plurality of moisture eliminator walls extending vertically between said top and bottom housing walls and being spaced laterally immediately downstream of said core back walls, with each said moisture eliminator wall being angled in the direction of the bypass gap in closest lateral proximity thereto, such that the flow of air exiting from each said evaporative core is intermixed with the flow of air exiting from said bypass gap; and, a butterfly-type bypass damper having two blades mounted for pivoting movement in each of said bypass gaps between closed and open positions, said bypass dampers substantially blocking said bypass gaps to the flow of air therethrough in said closed positions and substantially opening said bypass gaps to the flow of air therethrough in said open positions, and said bypass dampers being selectively positionable at said closed and open positions and at positions intermediate said closed and open positions, such that as said damper is opened, said two blades are angled in the direction of said evaporative core in closest lateral proximity thereto and the flow of air exiting said bypass gap is intermixed with the flow of air past said dampers 5. A humidifier for adding moisture to a flow of air through the humidifier comprising, in combination:

a housing defined by a top housing wall, a bottom housing wall and two side housing walls, with lateral edges on opposite sides of said top, bottom and side housing walls forming a housing inlet on one end of said housing and a housing outlet on an opposite end of said housing;

a plurality of evaporative cores mounted adjacent one another transversely within said housing, said evaporative cores including vertical sidewalls laterally spaced apart to define bypass gaps between said cores, front core walls and back core walls;

said front and back core walls being formed of permeable plastic coated wire mesh to allow the flow of air therethrough, with said cores including evaporative media within said core walls for adding moisture to the air flowing through said cores;

a plurality of moisture eliminator walls disposed between said top and bottom housing walls and being spaced laterally immediately downstream of said core back walls, with each moisture eliminator wall being angled in the direction of the bypass gap in closest lateral proximity thereto, such that the flow of air exiting from each said evaporative core is intermixed with the flow of air exiting from said bypass gap; and, a butterfly-type bypass damper having two blades mounted for pivoting movement in each of said bypass gaps between closed and open positions, said bypass dampers substantially blocking said bypass gaps to the flow of air therethrough in said closed positions and substantially opening said bypass gaps to the flow of air therethrough in said open positions, and said bypass dampers being selectively positionable at said closed and open positions and at positions intermediate said closed and open positions, such that as said damper is opened, said two blades are angled in the direction of said evaporative core in closest lateral proximity thereto and the flow of air exiting from said bypass gap is intermixed with the flow of air exiting from said dampers.

* * * * *